US005520439A

United States Patent [19]

Blount

[11] Patent Number: 5,520,439

[45] Date of Patent: May 28, 1996

[54] FULLY RECLINABLE ELEVATOR LIFT CHAIR

[76] Inventor: Eric D. Blount, Rte. 1, Box 254, Calhoun City, Miss. 38916

[21] Appl. No.: 340,842

[22] Filed: Nov. 17, 1994

[51] Int. Cl.[6] ..... A47C 1/02

[52] U.S. Cl. ..... 297/330; 297/DIG. 10; 297/362.11

[58] Field of Search ..... 297/330, DIG. 10, 297/362.11

[56] References Cited

U.S. PATENT DOCUMENTS

| | | | |
|---|---|---|---|
| 3,147,038 | 9/1964 | Barabas | 297/89 |
| 4,333,681 | 6/1982 | Nelson | 297/330 |
| 4,688,557 | 8/1987 | Bradstreet | 297/330 |
| 4,752,100 | 6/1988 | Lemaire | 297/330 |
| 4,909,569 | 3/1990 | Gaffney | 297/DIG. 10 |
| 5,094,508 | 3/1992 | Bathrick et al. | 297/330 |
| 5,165,753 | 11/1992 | Henderson | 297/330 |
| 5,294,179 | 3/1994 | Rudes et al. | 297/330 |

*Primary Examiner*—Peter M. Cuomo
*Assistant Examiner*—Anthony D. Barfield
*Attorney, Agent, or Firm*—G. R. Jarosik

[57] ABSTRACT

A reclinable, lift chair is provided being movable between a fully reclined and forward lifted positions, comprising a chair portion, a back portion, and a base member having front and rear portions, a lower ground engaging surface that defines a first plane, and an upper surface that defines a first mating surface. A sub-frame assembly supports the chair portion and includes a front, rear, and side portions and a second mating surface that is engageable with the first mating surface. The sub-frame assembly is rotatably connected to the base at the front portion thereof wherein the sub-frame assembly further comprises a rotatable beam having a back support member to which the back portion is attached. A motor further links the base to the rotatable beam for moving the sub-frame assembly between a first position wherein the sub-frame assembly is inclined forward relative to the first plane, a second position wherein the second mating surface engages the first mating surface and the back portion is in a plane substantially traverse to the first plane, and a third position wherein the second mating surface engages the first mating surface and the back portion is positioned in a plane substantially parallel to the first plane.

8 Claims, 3 Drawing Sheets

FULLY RECLINABLE ELEVATOR LIFT CHAIR

BACKGROUND OF THE INVENTION

This invention relates to lift chairs and, more particularly, to reclinable, elevator or lift chairs used by invalids, elderly, disabled and/or injured persons. In the care of such persons, there is commonly employed a chair having an occupant assisting feature in the form of a mechanical or electro-mechanical mechanism that powers the chair upwardly and forwardly to assist the occupant in moving from a sitting position to a standing position.

An example of a typical chair lift mechanism currently in use may be found in U.S. Pat. No. 5,165,753, issued Nov. 24, 1992 to Eldred D. Henderson, for an "Elevator Chair Apparatus" which is hereby incorporated by reference in its entirety. The '753 patent discloses a lift chair or elevator chair apparatus which is provided with a base portion having an inclined upper surface and a sub-frame assembly pivotally attached thereto along a forward edge. A mechanical ram powered by an electric motor pivots the sub-frame with respect to the base and about the forward pivot. The inclined upper surface of the base receives the sub-frame thereon in a fully downward position and defines the extreme reclined position. Pivotal rotation of the sub-frame with respect to the base and upon the pivot to an uppermost position defines the forward most lifting position. Throughout the moving process the chair remains rigid as the back is fixedly attached to the chair. Thus, the back of the chair is unable to attain a reclined position. Therefore, a need exists for a chair having improved flexibility in design whereby the occupant may achieve a fully reclined rest position.

Reclining chairs of the non-lifting type often allow for tilting of the back relative to the seat portion of the chair through the use of complex linking mechanisms. An example of one such chair of the motorized variety may be found in U.S. Pat. No. 4,365,836 issued to Jackson et al. on Dec. 28, 1982. The '836 patent discloses a seat which is coupled to a stationary frame by two quadrilateral linkages, one on each side of the chair. As known, the more complex the linking mechanism the more costly the chair. Therefore, a further need exists for a simplified and less costly linking mechanism for allowing the back to move relative to the seat in a reclinable chair.

As a result of these existing needs, it is an object of the present invention to provide a simplified and less costly motorized lifting chair of the type with a reclinable back.

SUMMARY OF THE INVENTION

In accordance with the present invention, a lift chair being movable between reclining and forward lifting positions is provided. The lift chair includes a chair portion and a back portion, a base member having front and rear portions, a lower ground engaging surface that defines a first plane, and an upper surface that defines a first mating surface. A sub-frame assembly supports the chair portion and includes a front, rear, and side portions and a second mating surface that is engageable with the first mating surface. The sub-frame assembly is rotatably connected to the base at the front portion thereof wherein the sub-frame assembly further comprises a rotatable beam having a back support member to which the back portion is attached. A motor further links the base to the rotatable beam and allows the sub-frame member to be moved between a first position wherein the sub-frame member is inclined forward relative to the first plane, a second position wherein the second mating surface engages the first mating surface and the back portion is positioned in a substantially upright position, and a third position wherein the second mating surface continues to engage the first mating surface but the back portion is positioned in a fully reclined position.

A better understanding of the objects, advantages, features, properties and relationships of the invention will be obtained from the following detailed description and accompanying drawings which set forth an illustrative embodiment and is indicative of the various ways in which the principles of the invention may be employed.

BRIEF DESCRIPTION OF THE DRAWINGS

For a better understanding of the invention, reference may be had to the embodiment shown in the following drawings in which.

DETAILED DESCRIPTION

Figure 1:
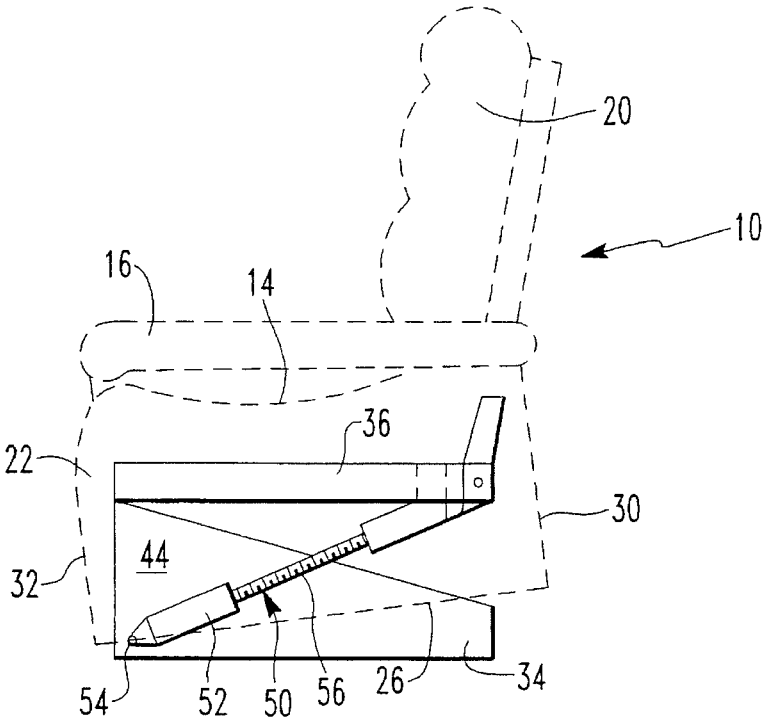
FIG. 1 illustrates a side view of the present invention in a slightly raised position.
Figure 2:
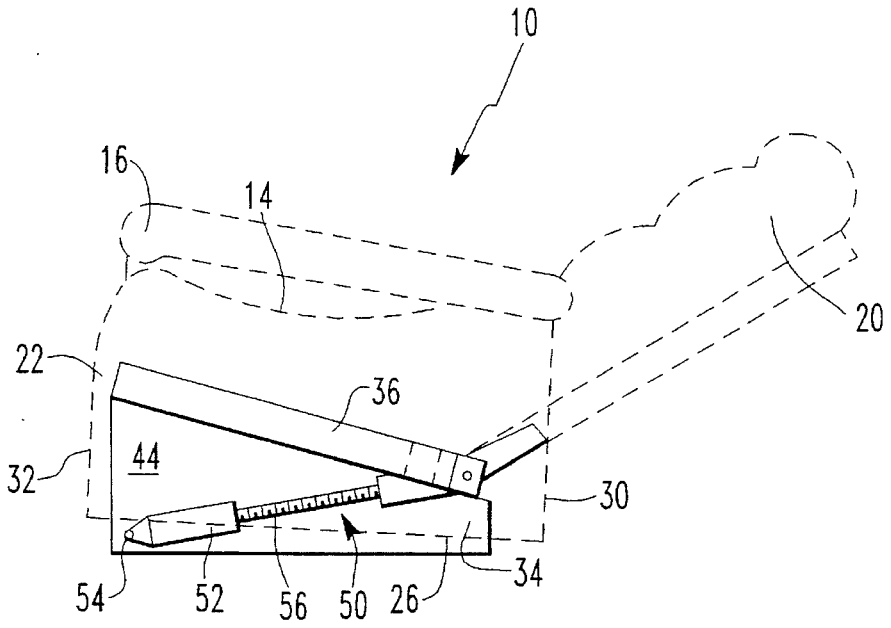
FIG. 2 illustrates a side view of the invention shown in FIG. 1 in the fully reclined position.
Figure 3:
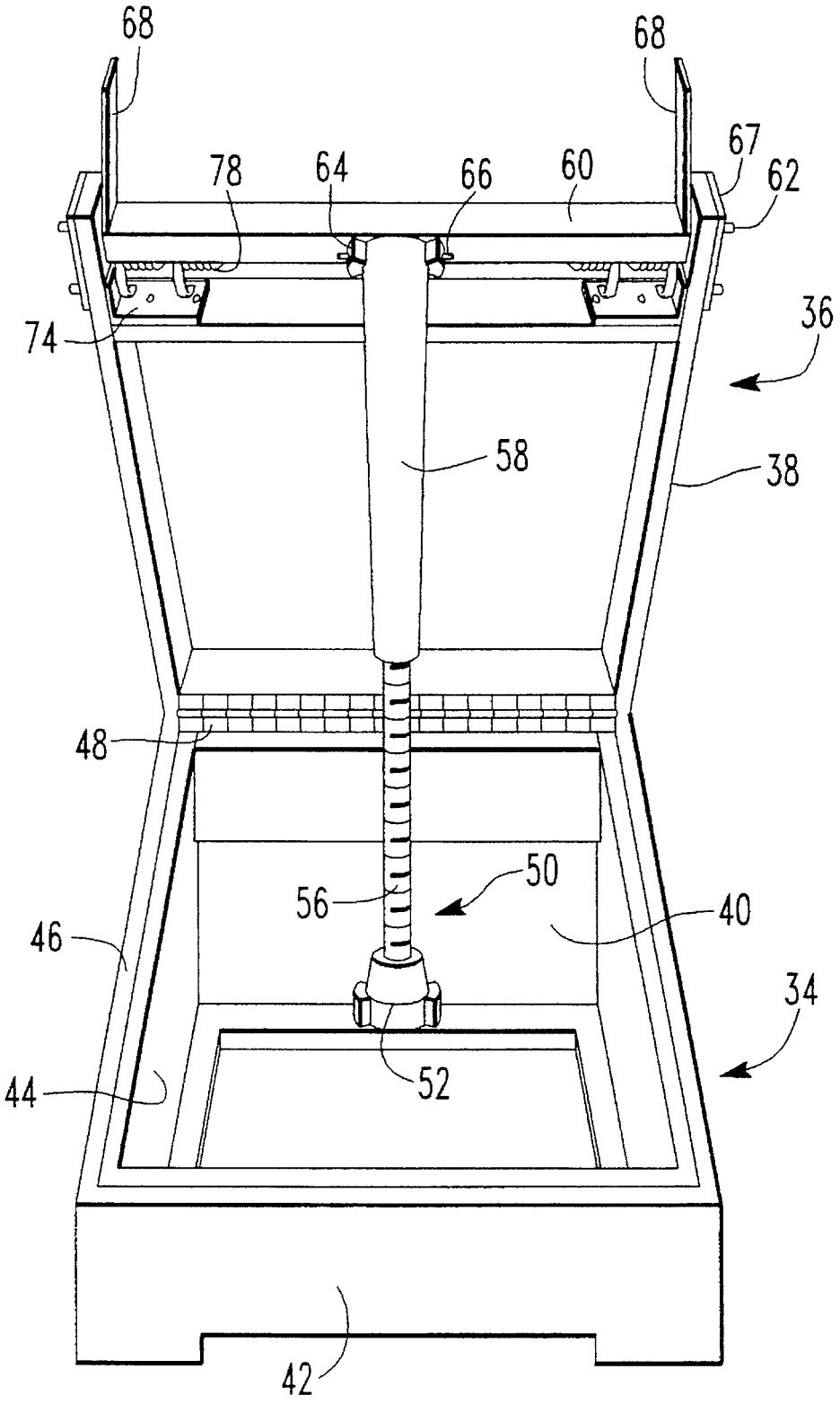
FIG. 3 illustrates a perspective view of the invention shown in FIG. 1.
Figure 4:
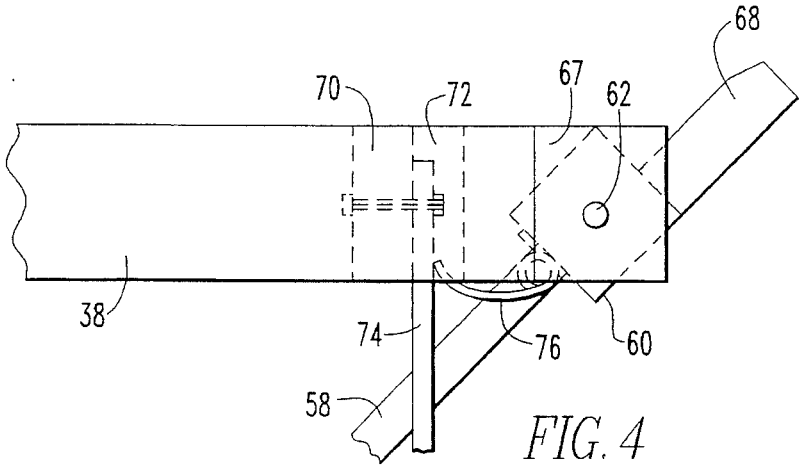
FIG. 4 illustrates a partial, close-up side view of the invention shown in FIG. 1.
Figure 5:
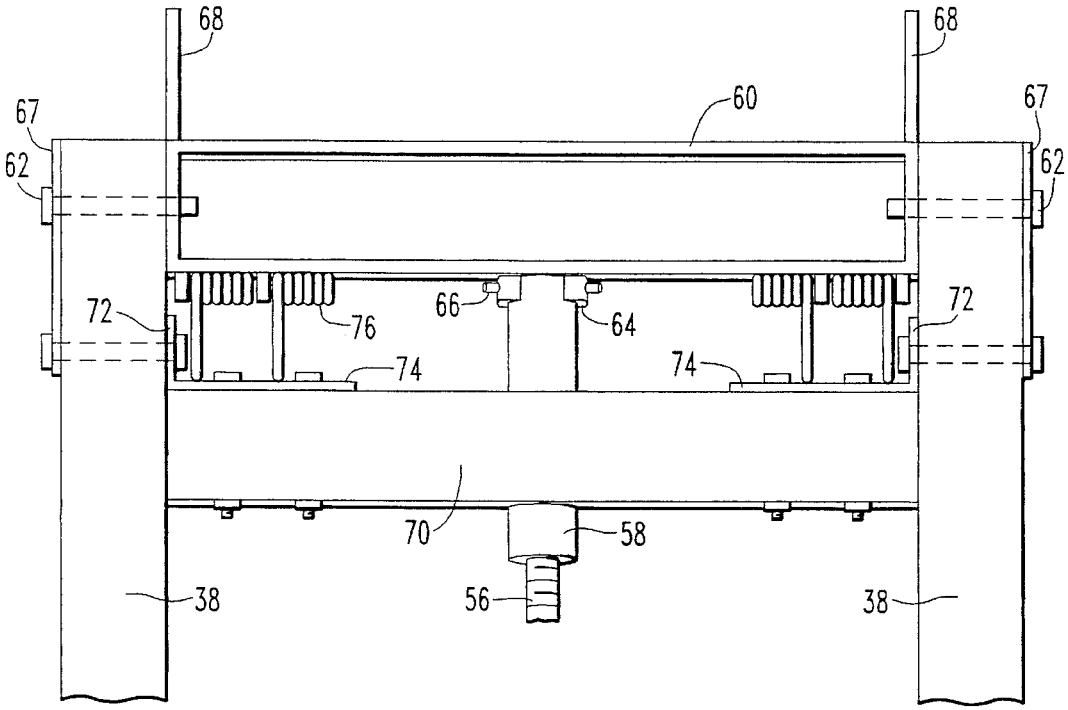
FIG. 5 illustrates a partial, close-up top view of the invention shown in FIG. 1.

While the invention can be used in relation with any type of furniture it will be described hereinafter in the context of a reclinable, elevator lift chair as the preferred embodiment thereof.

Referring now to the figures, wherein like reference numerals refer to like elements, there is generally shown in the Figures a chair assembly 10 including a chair portion 12 which is comprised of seat 14, spaced apart arms 16, and back 20. The chair portion 12 further includes sides 22 that each extend below arms 16 and which terminate at bottom edges 26, rear edges 30, and front edge 32. The chair frame is typically constructed of wood and covered with foam and fabric in a manner known in the art.

The chair portion 12 of lift chair apparatus 10 is able to move with respect to base portion 34 as the chair portion 12 is supported upon a sub-frame assembly 36. The sub-frame assembly 36 includes a pair of spaced apart longitudinally extending beams 38 and a rear transverse beam 39. In the preferred embodiment, the beams 38,40 are of equal height, made of wood, and fastened at the end using metallic L-brackets which can be affixed to the beams in a known manner.

Base 34 similarly includes front and rear walls 40,42 and sidewalls 44. The sidewalls 44 provide support surfaces 46 which may be inclined in construction wherein the front wall 40 is of equal width but greater height than rear wall 42. The sub-frame 36 may be pivotally attached at pivot or hinge 48 to the base 34. The pivot 48 may be a piano hinge, for example, extending fully across the top of front wall 40.

In the illustrated embodiment, the chair portion 12 of lift chair 10 including seat 14 and sides 22 are structurally attached to and move with the sub-frame 36. The sides 22 may be attached by bolts passing through beams 38 in a manner well known to those skilled in the art.

The lifting mechanism 50 is provided to pivot sub-frame 36 with respect to base 34 about pivot 48. A motor drive 52 can be affixed at pivot 54 to base 34, preferably in the proximity of front 40. The motor drive 52 includes a rotating threaded shaft 56 that extends from motor drive 52 upwardly to engage a ram 58. Ram 58 is a tubular sleeve having a longitudinal internally threaded bore. The internal threads of ram 58 engage the external threads of shaft 56 so that the threaded shaft 56 when rotated by motor drive 52 will cause the ram 58 to extend or retract accordingly. The movement of the ram 58 will similarly cause the sub-frame 36 to pivot upwardly or downwardly about pivot 48.

A first transverse beam 60 defines an attachment between ram 58 and sub-frame 36. Transverse beam 60 is pivotally attached about pivot pins 62 to each of the side beams 38 through plate 67 attached to the outside of each beam 38. Gusset plates 64 extend from beam 60 with pivot pin 66 forming a pivotal connection between the ram 58 and the plates 64. The transverse beam 60 further includes brackets 68 extending therefrom to which the frame which supports back 20 is attached in a conventional manner. Preferably, beam 60 comprises a 0.25 inch×2.5 inch×1.25 foot beam having a channel therein while pivot pins 62 are ⅜ inch steel pins and plates 67 have a 0.25 inch thickness.

The sub-frame 36 may also be equipped with a second transverse beam 70 which is fixed between side beams 38 by angle brackets 72 in proximity to beam 60. Attached by bolts or the like to beam 70 at either side thereof are downwardly extending steel plates 74, preferably 0.25 inch×6.5 inch×6 inch. Similarly, beam 60 may be provided at either end with flanges or brackets 76, attached on the same side of the beam 60 as plates 64, between which are mounted compression springs 78 for use in biasing the pivotally attached beam 60. Specifically, four springs are preferably used, two per side, where each spring has one end extending into contact with the underside of beam 60 and the other end extending into contact with the plates 74.

In operation, the reversible motor 52 may be caused to either drive ram 58 away from motor 52 or towards motor 52 depending upon the rotation given to shaft 56. When the ram 58 is caused to drive ram 58 outward, ram 58 pushes upon pivot pin 66 causing beam 60 to raise the back portion of sub-frame 36 about pivot point 48. This may continue until sub-frame 36 is positioned at such an incline relative to base 34 that the user is in a partially standing position. During this lifting procedure, the springs 76 act upon the beam 60 by biasing the beam against the rotation experienced about pivot points 62 as the ram 58 pushes against pin 66. The springs, therefore, function to keep the slack out of the movement allowing such movement to be smoother.

When the motor 52 is caused to pull ram 58 inward, ram 58 will pull on pivot pin 66 whereby the sub-frame 36 will follow beam 60 and pivot about hinge 48 until the underside of sub-frame 36 engages with the support surfaces of base 34. In this reclined position the back 20 supported upon brackets 68 continues to be somewhat upright in position. Once sub-frame 36 engages with base 34 the motor 52 may still cause ram 58 to be pulled inward by as much as two to three inches where the pivot connection point 66 will follow causing beam 60 to rotate about pivot point 62. As beam 60 rotates the back support 68 follows causing back 20 to assume a reclined position. In one embodiment the back may recline approximately 75 degrees from vertical with approximately 45 of those degree being after the sub-frame has engaged with base support surfaces. In another embodiment the back reclines to a position substantially horizontal to the plane on which the bottom of the chair base resides.

In yet another embodiment the plane of engagement between the sub-frame and the base is substantially horizontal to the plane on which the bottom of the chair base resides and the chair seat and back are positioned substantially parallel to this plane in the fully reclined position. As the chair is raised from the fully reclined position the back lifts first as the ram causes the beam 60 to rotate until a point is reached wherein further movement of the ram 58 raises the sub-frame from base 34. At this point the back is once again in a substantially upright position.

It should be apparent from the preceding description that this invention has, among other advantages, the advantage of providing a chair movable between three unique positions, these positions being where the chair is fully lifted, the chair is reclined with the back substantially upright, and the chair is reclined with the back substantially reclined.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

I claim:

1. A lift chair being movable between reclining and forward lifting positions, comprising:

a chair portion and a back portion;

a base member having a lower ground engaging surface that defines a first plane and an upper surface that defines a first mating surface;

a sub-frame assembly for supporting said chair portion having a rear portion and a second mating surface that is engageable with said first mating surface;

a pivot point where said sub-frame assembly is rotatably connected to said base member;

wherein said rear portion of said sub-frame assembly further comprises a rotatable beam pivotally mounted to said rear portion of said sub-frame assembly and having a back support member to which said back portion is attached; and a motor linking said base member to said rotatable beam for use in moving said sub-frame assembly and said rotatable beam and accordingly said chair portion and said back portion;

wherein said lift chair is movable between a first position wherein said chair portion is inclined forward relative to vertical, a second position wherein said second mating surface engages said first mating surface inhibiting further movement of said chair portion and said back portion is reclined rearward at an angle less than 45 degrees relative to vertical, and a third position wherein said second mating surface continues to engage said first mating surface and said back portion is reclined rearward at an angle greater than 45 degrees relative to vertical.

2. The lift chair as recited in claim 1, wherein said first mating surface and said second mating surface engage in a second plane transverse to said first plane.

3. The lift chair as recited in claim 1, wherein said motor causes said rotatable beam to rotate in a clockwise direction as said lift chair is moved from said third position and further comprising an engagement plate mounted to said sub-frame and a spring connected to said rotatable beam and engageable with said engagement plate for biasing said rotatable beam in the counter-clockwise direction.

4. The lift chair as recited in claim 3, wherein said motor includes a shaft having an external threading and a ram mounted over said shaft having a corresponding internal threading, said ram being pivotally connected to said rotatable beam opposite said back support member.

5. The lift chair as recited in claim 4, wherein said back is disposed approximately 75 degrees from vertical in said third position.

6. The lift chair as recited in claim 5, wherein said back is disposed approximately 30 degrees from vertical in said second position.

7. A lift chair being movable between reclining and forward lifting positions, comprising:

a chair portion and a back portion;

a base member having a lower ground engaging surface that defines a first plane and an upper surface that defines a first mating surface;

a sub-frame assembly for supporting said chair portion having a rear portion and a second mating surface that is engageable with said first mating surface in a second plane substantially parallel to said first plane;

a pivot point where said sub-frame assembly is rotatably connected to said base member;

wherein said rear portion of said sub-frame assembly further comprises a rotatable beam pivotally mounted to said rear portion of said sub-frame assembly and having a back support member to which said back portion is attached; and a motor linking said base member to said rotatable beam for use in moving said sub-frame assembly and said rotatable beam and accordingly said chair portion and said back portion;

wherein said lift chair is movable between a first position wherein said chair portion is inclined forward relative to vertical, a second position wherein said second mating surface engages said first mating surface for inhibiting further movement of said chair portion and said back portion is reclined rearward at an angle less than 45 degrees relative to vertical, and a third position wherein said second mating surface continues to engage said first mating surface and said back portion is reclined rearward in a plane substantially parallel to said first plane.

8. A lift chair being movable between reclining and forward lifting positions, comprising:

a chair portion and a back portion;

a base member having a lower ground engaging surface that defines a first plane and an upper surface that defines a first mating surface;

a sub-frame assembly for supporting said chair portion having a rear portion and a second mating surface that is engageable with said first mating surface;

a pivot point where said sub-frame assembly is rotatably connected to said base member;

wherein said rear portion of said sub-frame assembly further comprises a rotatable beam pivotally mounted to said rear portion of said sub-frame assembly and having a back support member to which said back portion is attached;

a motor linking said base member to said rotatable beam for use in moving said sub-frame assembly and said rotatable beam and accordingly said chair portion and said back portion; and an engagement plate mounted to said sub-frame assembly and a spring connected to said rotatable beam and engageable with said engagement plate for biasing said rotating beam against movement caused by said motor;

wherein said lift chair is movable between a first position wherein said chair portion is inclined forward relative to vertical, a second position wherein said second mating surface engages said first mating surface preventing the further movement of said chair portion and said back portion is reclined rearward at an angle less than 45 degrees relative to vertical, and a third position wherein said second mating surface continues to engage said first mating surface and said back portion is reclined rearward at an angle greater than 45 degrees relative to vertical.

* * * * *